US007197266B2

(12) United States Patent
Fordahl et al.

(10) Patent No.: US 7,197,266 B2
(45) Date of Patent: Mar. 27, 2007

(54) INK DISPOSAL IN CARTRIDGES

(75) Inventors: A. Kristine Fordahl, Hopkins, MN (US); James A. Baker, Hudson, WI (US)

(73) Assignee: Samsung Electronics Co, Ltd, Suwon (KR)

( * ) Notice: Subject to any disclaimer, the term of this patent is extended or adjusted under 35 U.S.C. 154(b) by 0 days.

(21) Appl. No.: 10/909,698

(22) Filed: Aug. 2, 2004

(65) Prior Publication Data

US 2005/0002696 A1 Jan. 6, 2005

Related U.S. Application Data

(62) Division of application No. 10/286,415, filed on Oct. 31, 2002, now Pat. No. 6,907,213.

(51) Int. Cl.
*G03G 15/10* (2006.01)
*G03G 21/12* (2006.01)

(52) U.S. Cl. ..... 399/237; 399/360

(58) Field of Classification Search ..... 399/35, 399/61, 120, 358–360, 237–240, 249, 250
See application file for complete search history.

(56) References Cited

U.S. PATENT DOCUMENTS

| | | | | |
|---|---|---|---|---|
| 4,269,959 | A | 5/1981 | Lawton | 526/194 |
| 4,524,365 | A | 6/1985 | Kakeno et al. | 346/75 |
| 4,529,656 | A | 7/1985 | Haigh et al. | 428/402 |
| 5,157,421 | A | 10/1992 | Kitahara | 346/140 |
| 5,458,773 | A | 10/1995 | Holland | 210/282 |
| 5,527,457 | A | 6/1996 | Holland | 210/170 |
| 5,579,038 | A | 11/1996 | Kimura | 347/36 |
| 5,588,785 | A | 12/1996 | Holland | 405/270 |
| 5,645,378 | A | 7/1997 | Holland | 405/270 |

(Continued)

FOREIGN PATENT DOCUMENTS

| | | |
|---|---|---|
| EP | 0 638 850 A2 | 2/1995 |

(Continued)

OTHER PUBLICATIONS

Text of the First Office Action.

*Primary Examiner*—David M. Gray
*Assistant Examiner*—Ryan Gleitz
(74) *Attorney, Agent, or Firm*—Mark A. Litman & Associate, P.A.

(57) ABSTRACT

An apparatus for assisting in the removal or waste or excess ink and a method for disposal of ink from electrophotographic printers comprises providing electrophotographic ink from a source, combining the ink with an absorbable material in a container to form a solid within the container, and closing the container so that the container with the solid inside may be disposed of without ink flowing from the container.

14 Claims, 11 Drawing Sheets

72-Cartridge
100- Initial Ink position
74-Transportation means
76-Initial reservoir
78-Ink
80-Outlet
82-Tube or hose
84-Inlet
86-Cartridge housing
88-Absorbent
90-Sensor
92-inlet/connector
94-outlet/connector
96-pump

U.S. PATENT DOCUMENTS

| | | | | |
|---|---|---|---|---|
| 5,906,572 | A | 5/1999 | Holland | 588/255 |
| 5,933,689 | A * | 8/1999 | Kim | 399/359 |
| 5,993,372 | A | 11/1999 | Holland | 588/255 |
| 6,009,289 | A | 12/1999 | Sekine et al. | 399/113 |
| 6,011,943 | A | 1/2000 | Kim | 399/238 |
| 6,018,637 | A | 1/2000 | Huss et al. | 399/102 |
| 6,027,653 | A | 2/2000 | Holland | 210/690 |
| 6,101,356 | A | 8/2000 | Kim et al. | 399/250 |
| 6,151,469 | A | 11/2000 | Lee | 399/237 |
| 6,203,137 | B1 | 3/2001 | Niimura et al. | 347/36 |
| 6,231,758 | B1 | 5/2001 | Morris et al. | 210/163 |
| 6,249,655 | B1 | 6/2001 | Back et al. | 399/12 |
| 6,281,911 | B1 | 8/2001 | Nakazawa et al. | 347/36 |
| 6,363,233 | B1 | 3/2002 | Nakajima | 399/120 |

FOREIGN PATENT DOCUMENTS

| | | |
|---|---|---|
| EP | 0 928 694 A1 | 8/1998 |
| EP | 98940591.5 | 8/1998 |
| JP | 04-139786 | 5/1992 |
| JP | 10254246 A * | 9/1998 |

* cited by examiner

2. Cartridge
4. Housing
6. Portal
8. Closure (open)
10. Absorbent

2. Cartridge
4. Housing
6. Portal
8. Closure (closed)
10. Absorbent

2. Cartridge
4. Housing
12. Valve
10. Absorbent

70-Cartridge
100- Initial Ink position
74-Transportation means
76-Initial reservoir
78-Ink
80-Outlet
82-Tube or hose
84-Inlet
86-Cartridge housing
88-Absorbent
90-Sensor 72-Cartridge
100- Initial Ink position
74-Transportation means
76-Initial reservoir
78-Ink
80-Outlet
82-Tube or hose
84-Inlet
86-Cartridge housing
88-Absorbent
90-Sensor
92-outlet/connector
94-inlet/connector
96-pump 72-Cartridge
100- Initial Ink position
74-Transportation means
76-Initial reservoir
78-Ink
80-Outlet
84-Inlet
86-Cartridge housing
88-Absorbent
90-Sensor 72-Cartridge
100- Initial Ink position
74-Transportation means
76-Initial reservoir
78-Ink
80-Outlet
82-Tube or hose
84-Inlet
86-Cartridge housing
88-Absorbent
90-Sensor
92-inlet/connector
94-outlet/connector
96-pump

INK DISPOSAL IN CARTRIDGES

RELATED APPLICATION DATA

This Application is a Divisional Application claiming priority from U.S. patent application Ser. No. 10/286,415, filed Oct. 31, 2002 now U.S. Pat. No. 6,907,213.

BACKGROUND OF THE INVENTION

1. Field of the Invention

The present invention relates to an electrophotographic apparatus using liquid toner and particularly to liquid ink or liquid toner cartridges that can be used to dispose of unused, overflow liquid ink or other unusable liquid ink or toner.

2. Background of the Art

Ink cartridges are known in the art for both ink jet and electrophotographic printing. Ink cartridges are used to introduce liquid or dry toner into a printer for use in printing and may be used for waste toner disposal as well. Some examples of combination cartridges include U.S. Pat. Nos. 6,009,289 and 6,363,233 for dry toner cartridges and U.S. Pat. No. 5,157,421 for ink jet cartridges.

An electrophotographic apparatus that uses liquid toner realizes several advantages over an electrophotographic apparatus that uses dry toner. One such advantage is the achievement of finer resolution prints due to smaller particle size. Because the particles are smaller, a lower mass of toner is required to print to the necessary optical density, reducing the cost per page. Another advantage is liquid toner's lack of airborne dry toner particulate (known carcinogens). Liquid toner also tends to have a longer shelf life because of increased charge stability with respect to dry toner.

The use of liquid toner in an electrophotographic apparatus has problems as well. For example, a typical liquid electrophotographic printer will use a hydrocarbon-based carrier liquid to transport the toner particles to the discharged area on a photoreceptor. When the ink solids have been depleted, what remains is a significant quantity of hydrocarbon solvent, possibly contaminated with charged particles and resin. Current U.S. Environmental Health Regulations will not allow hydrocarbon solvents to be disposed of in a landfill without alteration. Regulations also prohibit shipping such liquid and hazardous waste for recycling while the waste is in liquid form.

Other imaging fields can avoid these problems. In the case of dry toner, unused toner and waste toner are typically disposed of in the original cartridge and recycled by shipping the cartridge out in a mailer.

In the ink jet field, various means are employed to eliminate waste ink. Since the ink is typically aqueous, many manufacturers simply allow waste carrier to evaporate. Others realize that since the carrier is aqueous and since there is such a small quantity of waste, the cartridges may be simply landfilled. Some manufacturers include absorbents like folded paper in the cartridges to keep the waste carrier relatively immobile, as in U.S. Pat. No. 6,220,314. Some ink jet technologies, such as U.S. Pat. Nos. 5,157,421 and 6,281,911, use a two-chamber construction, with one chamber bearing fresh ink and with the waste ink being disposed of in the other chamber as it is generated. This appears to work very well for the small quantities of ink.

In the liquid electrophotographic art, these preceding solutions are not viable alternatives due to the hazardous nature of the solvent and the severe limitations placed on the shipment and disposal of the liquid.

Various means are known for removing liquid toner from a printing apparatus. Some of those means include pumping liquid from a developer unit or evaporating the used carrier from a plated image. In any case, a quantity of liquid solvent still remains, and, unless it is recycled for use in the apparatus, it cannot remain in the system. Some examples of prior art for carrier removal are U.S. Pat. Nos. 6,101,356, 6,011,943, and 5,933,689.

Most of the countries of the world maintain environmental health and safety regulations; and most of those countries do not allow liquid hazardous waste to be transported through regular delivery channels. Most of those countries also do not permit landfilling of liquid hazardous waste. As a result, liquid electrophotography has been searching for a way to safely and legally dispose of the unused and waste ink.

SUMMARY OF THE INVENTION

This invention addresses problems associated with the environmentally-safe disposal of waste liquid toner. (The terms "waste toner" and "waste ink" are used interchangeably to refer to any liquid toner, ink or carrier fluid of which disposal is desired).

In one aspect of the invention, a method for disposing of waste liquid electrophotographic ink is described. The method includes providing waste amounts of a liquid electrophotographic ink, combining the ink with an absorbent, preferably combining the ink with the absorbent in an ink disposal cartridge, and then disposing of the combination. The absorbent with the ink may be removed from the cartridge for disposal or the cartridge containing the ink and absorbent can be disposed of in a landfill. This can be done because the combination of ink and absorbent will retard flow of the ink and its components or residue from leaking into the environment. The retardation is so significant that the combination of ink and absorbent can pass environmental standards tests for landfill materials. In a preferred embodiment, the absorbent prevents impermissible toxic leaching into the environment. The absorbent may also have a catalyst, bacteria or active ingredient therein that will assist in the breakdown of the ink into environmentally acceptable materials.

In one embodiment of the method, the ink is added to a non-leaching absorbent that is already contained in a landfillable housing. The term "non-leaching absorbent" means that the absorbent retains the solvent with sufficient strength that ambient moisture and water in landfills will not remove solvent in an amount that would be prohibited by regulatory provisions. For example, the absorbent with 20% by weight solvent sitting in black dirt with 10% by weight water content, would not remove 2% of the solvent (that is 0.4% of the weight of solvent plus absorbent) in a six-month period at 20° C. In another embodiment of the method, the ink is transferred into the absorbent, as by pumping into the absorbent. The combination of ink and absorbent (in a temporary or permanent housing or separate from a housing) may be disposed of in a landfill, provided that the combination passes environmental regulations in the country in which it is used.

In another embodiment of the method, the ink is absorbed into a solidifying absorbent that is already provided in a pre-labeled housing suitable for shipping and possibly for direct land-filling or recycling. The combination then forms a solid that may be shipped to a recycling center. Solidification may be effected by polymerization, gelation, thickening, cooling from an elevated temperature down to ambient temperatures, and partial evaporation in a controlled environment. Solidification may involve only the fact that the liquid ink, by absorption into the absorbent, becomes a solid mass due to the structure and solidity of the absorbent.

In yet another embodiment of the method, the ink is fed into a holding container. This holding container may either be disposable, or may be a permanent part of the printing apparatus. When the time comes to dispose of the ink, absorbent media may be added to the ink (or vice-versa), either freely (by pouring or triggering a release mechanism, for example) or as a pellet-type insertion into the cartridge. The entire housing may then be disposed of in a landfill or by recycling (depending on the housing material), or the cartridge pellet may be removed from the holding container (having absorbed the ink and solidified as much toner as possible) to be landfilled or recycled.

In another embodiment of the method, the initial supply cartridge is provided with an additional chamber bearing a quantity of a solidifying absorbent. When the ink solids are depleted or a waste ink chamber is full, a mechanism may be triggered automatically or by operator control to remove a barrier preventing the combination of the ink and the absorbent. When the toner and absorbent combine, a solid is formed, which solid may be shipped to a recycling plant or landfilled (depending on the ability of the cartridge components to be accepted and be stable in a landfill environment, referred to as "landfillability").

Another aspect of the invention is an ink disposal apparatus. One element of the apparatus is an ink disposal cartridge. In one feature of the apparatus, the ink cartridge may be used external to the printer. In one embodiment, ink or condensed carrier in an initial supply or waste position is collected or held within a housing (for example, an internal holding container). When the ink is ready for disposal, it is added to the ink disposal cartridge, where it is quickly solidified for disposal. Solidification may be by any method including but not limited to absorption into or onto a solid, polymerization, gelation, partial to complete evaporation or separation of solvent, and the like.

In another feature of the apparatus, the disposal cartridge may be positioned inside a printing apparatus. In this manner, ink can be automatically or operator directed for transfer into the disposal cartridge, and the disposal cartridge may be removed after certain amounts of use that are charted/recorded by the apparatus or when the cartridge is indicated or sensed as filled or near capacity. One element of this disposal cartridge feature is that a supply of waste toner or carrier liquid is maintained in the apparatus in an initial position or location, either for use or storage prior to disposal. This initial position or reservoir has an outlet so that the waste liquid may be pumped or drained. Preferably, the outlet is provided with the structural capacity to be both sealable and unsealable and a preferred embodiment for this structure is a valve that may be mechanically (by operation of the apparatus) or manually opened and/or closed to allow for fluid movement out of the outlet. Another sealable and unsealable structural element may be a hose or tube for transporting the ink. Such a hose or tube may also incorporate a device for providing differential pressure, such as a pump, for moving the waste liquid from the initial position. Gravity feed may also be used. A system for opening and closing flow through the tube or controlling the fluid pressure (from 0 up to the maximum flow capacity of the fluid) may be provided.

In this feature, the waste ink cartridge element has an inlet or valve element for the introduction of the waste toner or carrier. This inlet or valve may be substantially above, below or level with and in fluid connection to the outlet on the initial reservoir, or may be connected to the hose or transportation means used to direct the waste toner flow away from the initial cartridge. The waste ink cartridge also contains an absorbent disposed within a housing that is made of a carrier-impervious material (that is, a material that is a relatively permanent barrier to the carrier) and has been shaped to fit the internal printer design. For example, the sequence of elements could be reservoir, ink disposal cartridge and negative pressure pump; the pump reducing pressure in the ink disposal cartridge and enabling flow from the reservoir into the ink disposal cartridge.

One element that is particularly desirable in the apparatus is at least one sensor. Sensors in at least one embodiment of the invention provides a weight sensing, liquid flow volume sensing, or liquid level/height sensing function in conjunction with the ink cartridge. Another optional embodiment combines the sensor, such as the weight sensor with a machine disabling (on/off control) device. If the sensor indicates that an insufficient amount of ink is present in the ink supply cartridge, or too much ink is present in the ink disposal cartridge, the printer/toner apparatus may be disabled or turned off to prevent attempts at printing that would be expected to produce unsatisfactory results because of improper ink levels.

Yet another aspect of the invention is a waste ink cartridge and the use of the waste cartridge in the disposal of ink and/or carrier in printing systems. There are at least two broad features, structures or designs for the ink cartridges, each having various embodiments, which will be discussed in detail here.

The first featured cartridge is simply a disposal cartridge, for use either inside the printer (as a waste toner or waste carrier receptacle that can be removed and directly disposed of) or a cartridge positioned outside of the printer, the external cartridge being designed to receive waste toner and carrier liquid (e.g., after a previous collection in another receptacle or in the cartridge) prior to disposal in the disposal cartridge. Both uses will utilize essentially the same basic elements and design.

One element of the waste cartridge is the housing. The shape of the housing may essentially be any shape suited to the inside of the particular printer with which it is designed to work and/or in a shape best suited for ease of shipping and handling. As different printers from different manufacturers have unique cabinet and fitting/connector shapes, the cartridge shapes may also vary according to the design dictates of the manufacturer and the cartridge shape is therefore not fundamental to the practice of the present invention. The composition of the housing must be impervious (e.g., insoluble, non-dispersible, or impenetrable on storage) to the solvent used in the ink and may be selected from any material having this physical property that may be shaped into the housing. For example, polymeric materials, composite materials, coated materials, metals, ceramic materials, and other structural materials may be used for the housing. A preferred embodiment for the housing structure of the disposal cartridge is cardboard lined with a suitable coating such as wax, polymer, metal or sealant.

Another element of the disposal cartridge is a portal, preferably a sealable and unsealable (manually, automatically, processor controlled or operator controlled) portal for the introduction of ink, with a portal closing element (e.g., portal closure, flap, snap, seal, nozzle, gate, valve, etc.). One embodiment provides for a distinct inlet on the cartridge for the introduction of ink. The portal closure may be any structure that removably seals or closes the portal, such as a stopper, tab, flap, pincher, snap, or other physical closing structure. For example, a repositionable tab with adhesive tape on one side has been proven effective. A preferred embodiment provides a valve to open or close the portal. Of all available valves, a preferred embodiment is a snap or stem valve.

Yet another element of the invention is an oleophilic, non-leaching absorbent for the oleophilic ink. Embodiments of the absorbent include fibrous, porous, particulate, or other structural materials that are oleophilic and will attract and retain oleophilic inks in the structure. For example, such commercial materials as organic fabrics; organic reticulated foams; hydrophobized particles; compacted layers of absorbent materials; non-woven organic fiber structures; and the like may be used. Examples of commercial materials that have been proven particularly effective that have passed landfill leach testing are Enviro-bond™ 403 absorbent, Imbiber Beads® absorbent and Rubberizer® particulate. A preferred absorbent is Enviro-bond™ 403 absorbent, preferred for its ability to quickly absorb and solidify the waste toner. In another embodiment, the oleophilic absorbent may be combined with other absorbents, such as hydrophilic absorbents, in order to match the absorbency characteristics of a particular solvent, or to deal with minimal amounts of water vapor or condensation that may appear in the cartridge. Other embodiments include the use of adsorbents either alone or in conjunction with an absorbent.

In another feature of the waste ink disposal cartridge, a dual-chamber ink cartridge, having first and second chambers, is described. The first chamber has, at least, a supply of fresh ink for use in the printing device. Other embodiments may include, for example, hardware for developing or providing the ink onto a photoconductor, a photoreceptor, or for providing concentration control, among other options in the first chamber. The second chamber has, at least, a supply of a non-leaching, oleophilic absorbent. The second chamber may include other components not fundamental to this invention.

One element of the dual-chamber cartridge is the housing. The housing may essentially be any shape suited to the inside of the printer and/or in a shape best suited for ease of shipping and handling. As different printers from different manufacturers have unique cabinet shapes, the cartridge shape may also vary according to the design dictates of the manufacturer and is not fundamental to the practice of the present invention. The composition of the housing must be impervious (e.g., insoluble, non-dispersible, and impenetrable on storage) to the solvent used in the ink and may be selected from any material having this physical property that may be shaped into the housing.

An element of the second chamber is an oleophilic absorbent. As described above, various absorbents may be used, such as the absorbents listed above for the waste-ink only cartridge. Some embodiments of this chamber include and openable and closeable port for introduction of the waste ink and retention of any liquids remaining in the chamber when filled.

DETAILED DESCRIPTION OF THE INVENTION

Figure 1A:
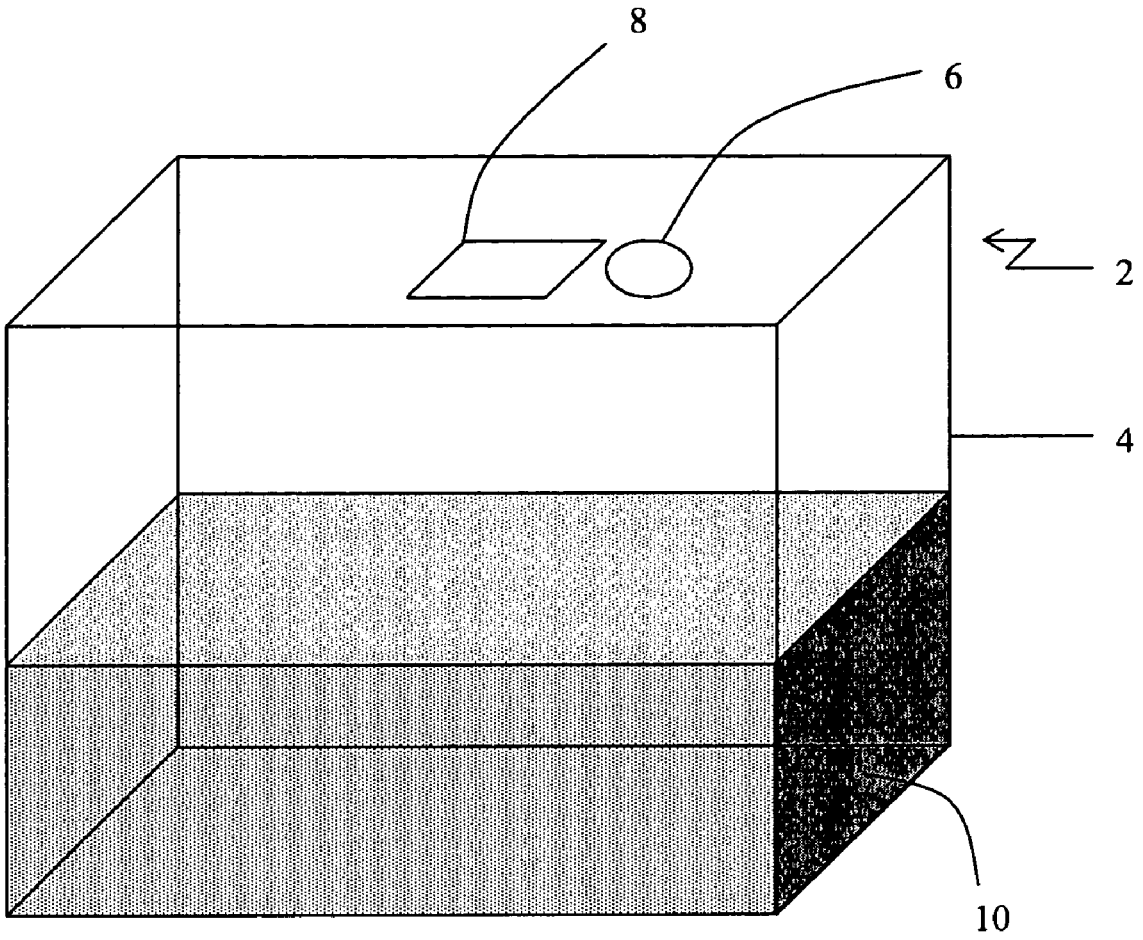
FIG 1*a* is a side view of a rectangular ink cartridge shown with a portal and removable adhesive closure, which is open.

In liquid electrophotographic printing, liquid electrophotographic ink cannot be shipped through regular mail systems due to hazardous liquid restrictions and cannot be landfilled, so leftover and waste ink cannot be disposed of through many traditional recycling programs. Generally, in a liquid electrophotographic printer, the solvent used in the ink is not landfillable, so disposal is not a matter of simply placing the unused or waste portion in a trash receptacle. The solvent cannot be placed into landfills not so much because of the chemical or toxic nature of the liquid, but because of its mobility and the tendency of the solvent to act on or react with other materials. Toxic materials may not be landfilled in general purpose landfills even in an entrapped or bound condition.

Some aqueous ink jet technology utilizes an absorbent placed within the ink jet ink supply cartridge, such as a folded paper absorbent. As the jets clean themselves, through dispensing ink, waste accumulates on the folded paper absorbent. Usually, there are air holes in the cartridge, so it is easy for the water in the aqueous-based ink to evaporate. Another aqueous ink jet technology uses a two-chamber bag, with one chamber bearing the "good" ink, and the "waste" ink being disposed in the other chamber as it is generated, which appears to work very well for small quantities of ink.

Most of the countries of the world maintain environmental health and safety regulations; and most of those countries do not allow liquid hazardous waste to be transported through regular delivery channels. Most of those countries also do not permit landfilling of liquid hazardous waste. As a result, liquid electrophotography has been searching for a way to safely and legally dispose of the unused and waste portions of their ink. The cartridges of the invention are provided with a quantity of a solidifying absorbent, either in a single chamber or (in the case of the ink supply cartridge of the invention) in a companion chamber. When the ink solids are depleted or a waste ink chamber is filled, a mechanism may be triggered automatically or by operator control to remove the barrier previously preventing the combination of the ink and the absorbent. When the toner and absorbent combine, a solid is formed, which solid may be shipped to a recycling plant or landfilled (depending on the ability of the cartridge components to be accepted and be stable in a landfill environment, referred to as "landfillability"). The resulting solid may even be non-leachable (for example, no more than 5% by weight total of dissolved, adsorbed or absorbed material is not removed by ambient conditions such as 20% moisture content in soil, at 20° C., over twelve months, with the capacity of the absorbent at 8)5 for the material retained), meeting stringent environmental standards. By leachable it is meant that organic liquid will not be removed at a rate greater than 5% total weight of organic liquids per year when contacted with distilled water at 20° C., with a replacement rate of the water of 1 liter/month/10 $m^2$ of surface area of solid containing the organic liquid.

In one embodiment, ink or condensed carrier in an initial supply or waste position is collected or held within a housing (for example, an internal holding container). When the ink is ready for disposal, it is added to the ink disposal cartridge, which contains the absorbent, where it is quickly solidified for disposal. Solidification may be by any method including but not limited to absorption into or onto a solid, polymerization, gelation, partial to complete evaporation or separation of solvent, and the like. Solidification may also include chemical binding to a substrate, in addition to physical binding. For example, the absorbent substrate may include bonding sites on the absorbent/adsorbent substrate, as with the use of polymer coatings having active binding sites (e.g., ethylenically unsaturated sites, acidic sites, basic sites, free hydrogen sites, complexing sites, etc.). Additionally, coupling agents may be applied to the surface of the absorbent substrate to have one portion of the coupling agent bind to the substrate, leaving another moiety available for bonding to the solvent or carrier in the ink. For example, titanates, silicates, ambifunctional silanes, ambifunctional acrylates, and the like may be used as coating on the substrate. In this regard, the "absorbent" may be more than just a physical absorbent or sponge, but chemically binds ingredients to the substrate to prevent release of the carrier liquid or other organic materials to the environment.

The invention will be better understood by reference to the non-limiting figures of the invention. It is to be noted that all structures shown in the figures are merely exemplary of broader structures, and that known physical alternatives to the structures shown are contemplated in the practice of the invention. For example, where a closure is shown as a flap, such physical equivalents as sliding gates, screw closures, snaps, sliding plates, manually inserted plugs, and the like are included in the concept of closures.

Where an absorbent is mentioned, such materials may comprise, but are not limited to: cellulose that has been treated to be oleophilic and substantially hydrophobic, elastomeric polymers, polymers (e.g., polypropylene, polyvinyl resins, polyamides, etc.) and other imbibitive and oleophilic media. Such media may be combined with other media or absorbents to accomplish the inventive purpose of solidifying and immobilizing the hydrocarbon liquid.

A preferred absorbent for many of the embodiments will solidify the hydrocarbon to the point that it is permanently encapsulated and non-leaching (as per current U.S. Environmental Protection Agency guidelines). Some of the materials tested include Enviro-bond™ 403 absorbent, Imbiber Beads® absorbent and Rubberizer® absorbent, as well as RamSorb™ absorbent and OARS Skimmers absorbent. These materials variously comprise, fabric, coating materials, solid film, powders, foams, and other solid absorbent materials.

FIG. 1*a* shows a side view of a rectangular ink supply cartridge 2 shown with a housing 4, a portal 6, a closure 8, and the absorbent 10. In the FIG. 1*a* the closure is provided as a removable adhesive closure of a flat strip and adhesive on one face. The closure 8 is shown in an open position. The shape of the housing 4 is shown as a rectangle for simplified purposes and may be adapted to suit the inside of the printing apparatus or for ease of recycling or shipping. The shapes of the portal 6 and the closure 8 are merely an artistic rendering, and may be designed to fit the appropriate connectors and fluid conveying elements that may be used with the printer and cartridge. The location of portal 6 is shown at the top of the cartridge housing, but it may also be placed in a convenient or accessible location, depending on the shape of the housing.

Figure 1B:
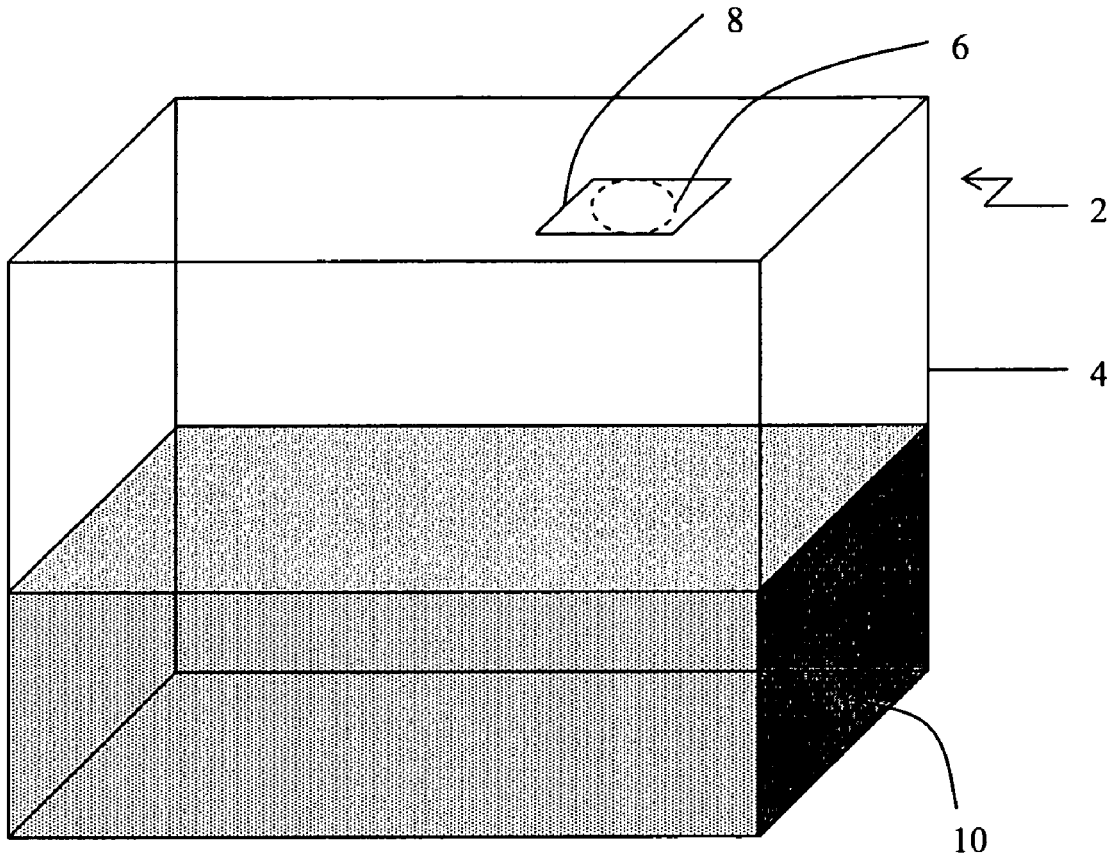
FIG. 1*b* is a side view of a rectangular ink cartridge shown with the removable adhesive closure over the portal in a closed position.

FIG. 1*b* shows side view of a rectangular ink supply cartridge 2 with a combined portal 6 and removable adhesive closure 8, which is closed. The housing 4 and absorbent 10 are as shown in FIG. 1*a*.

Figure 2:
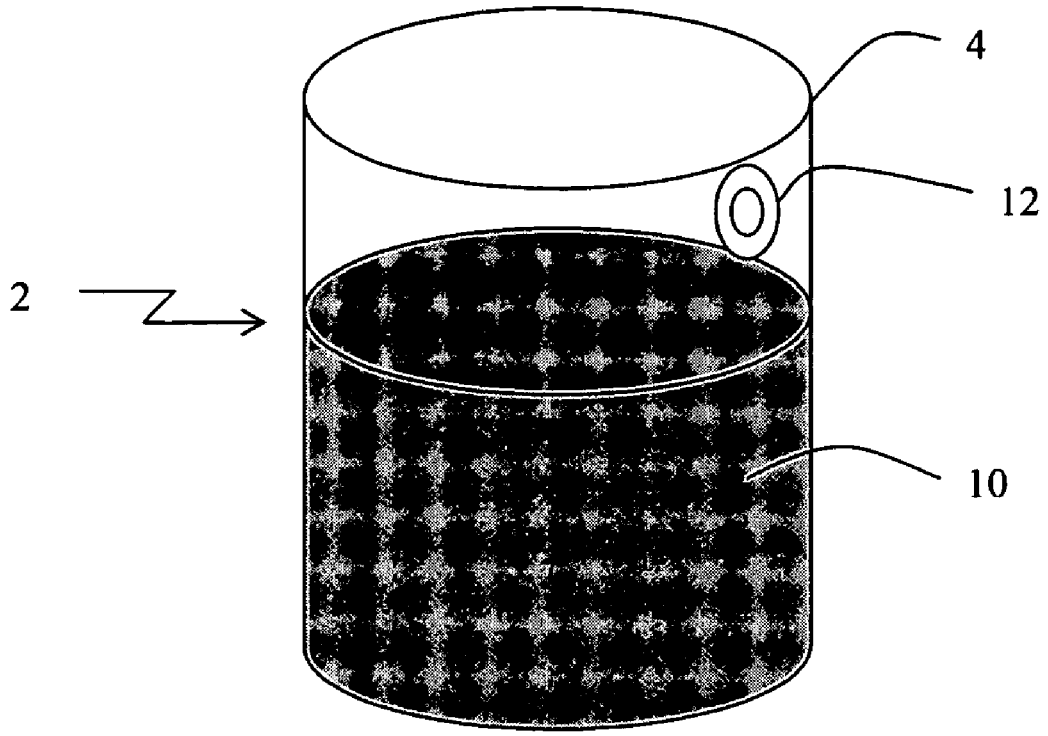
FIG. 2 is a side view of a cylindrical ink cartridge showing a pop-type valve in the closed position.

FIG. 2 shows an ink receptor cartridge 2 and the housing 4, an inflow valve 12 and absorbent 10. Inflow valve 12 is shown here positioned in the side of the housing, which in this case, is a cylinder. FIG. 2 represents a cartridge identical to the cartridge in FIGS. 1*a* and 1*b*, with the valve being the distinguishing factor. While inflow valve 12 is shown as a pop valve, any physical equivalent capable of sealing and unsealing the aperture is effective, such as: gate valves, ball valves, and the like.

Figure 3:
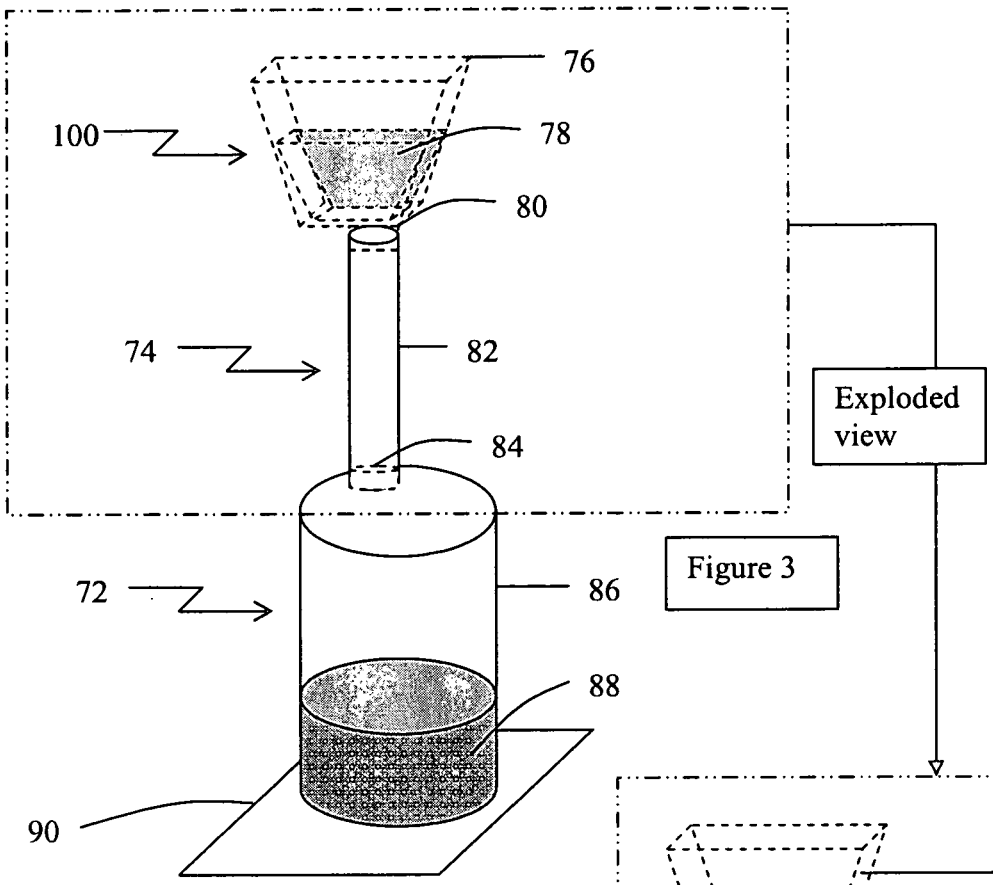
FIG. 3 is a side view of the waste ink apparatus showing one means of transporting waste ink from the initial reservoir into the waste cartridge.

FIG. 3 shows a side view of the waste ink apparatus showing one means of transporting waste ink from the initial reservoir or supply cartridge 76 into the waste cartridge 72. In use, the ink supply cartridge 100 has an initial reservoir 76 has an initial amount of ink 78. There is an outlet 80 in the ink supply cartridge 100 leading to a transportation system 74 which is shown as a conveyor, such as a tube or pipe 82 which may be rigid as shown, or may be a flexible hose. The conveyor 74 is in fluid transporting connection with an inlet 84 to an ink receptor cartridge housing 86 in the ink receptor cartridge 72. There is an absorbent 88 shown in the cartridge housing 86 and a sensor 30 to sense the amount of take-up (presumptively of ink) by the ink receptor cartridge 72.

Figure 3A:
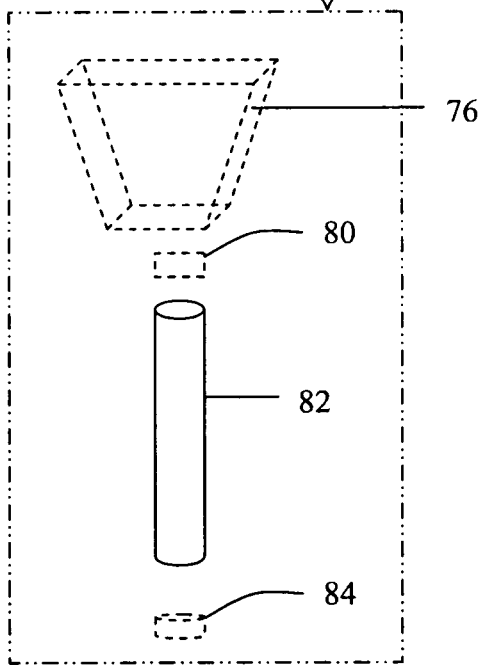
FIG. 3*a* is a side view of FIG. 3, showing an exploded view of how the components fit together.

FIG. 3*a* shows an exploded view of the FIG. 3 transportation embodiment.

Figure 3B:
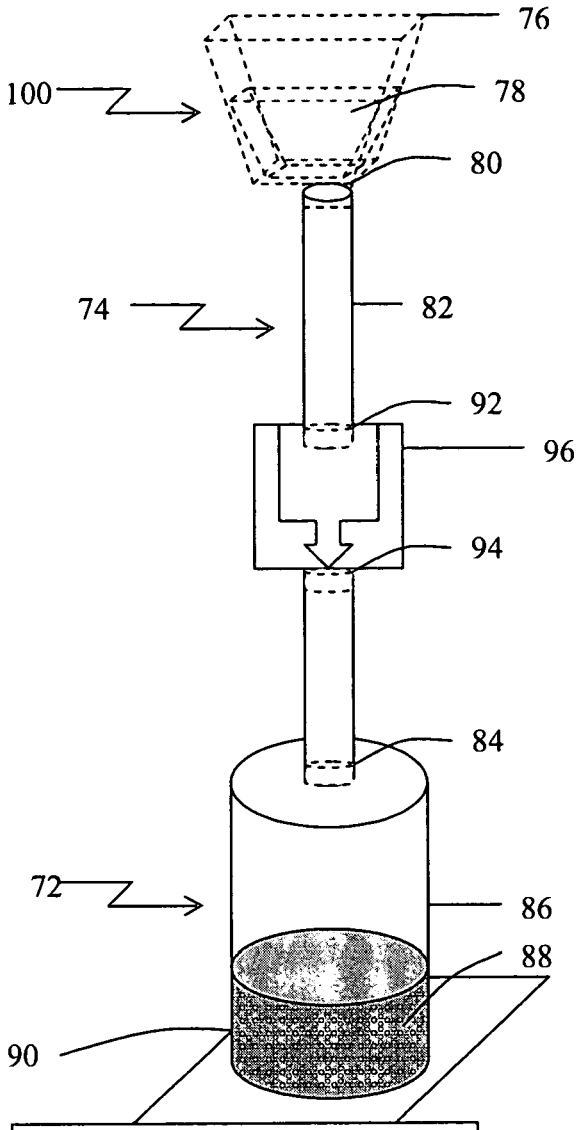
FIG. 3*b* is a side view of the waste ink apparatus showing a pump included in the means for transporting the ink into the cartridge.

FIG. 3*b* shows the FIG. 3 transportation embodiment, further comprising a pump or differential pressure generator 96 in fluid connection with waste ink transportation means 74 as described above.

Figure 3C:
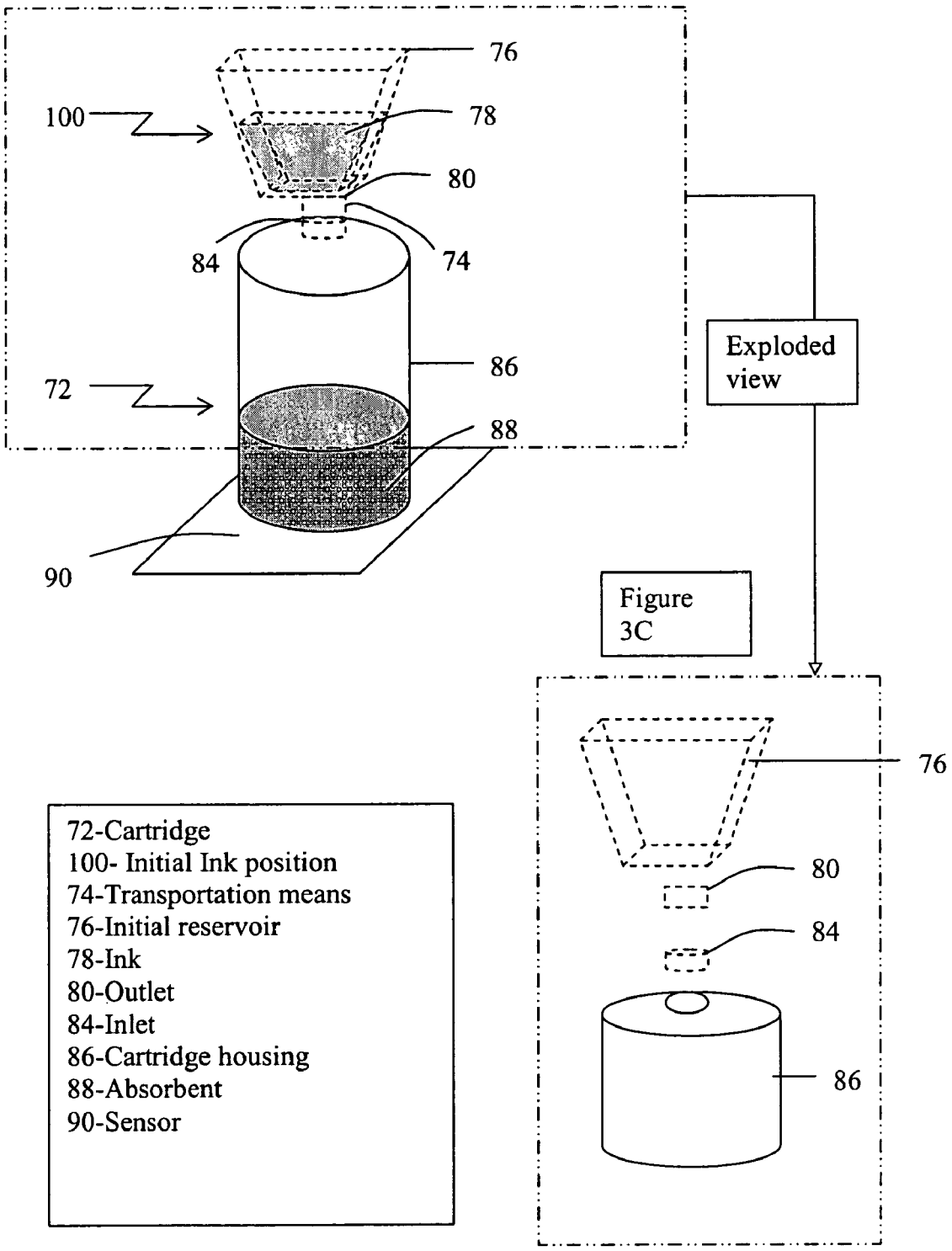
FIG. 3*c* is a side view showing the waste ink apparatus without an intermediate transportation means.

FIG. 3*c* shows a liquid ink supply cartridge or reservoir 100 connected directly to the ink disposal cartridge 72 with fittings or valves 80 and 84.

Figure 3D:
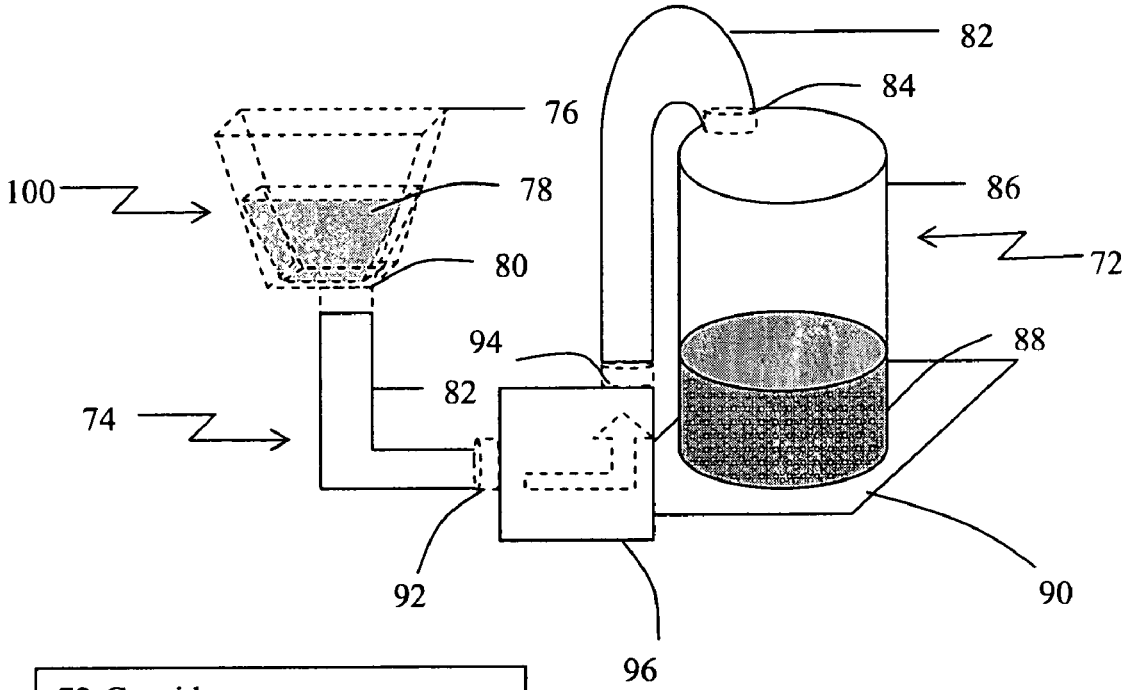
FIG. 3*d* is a side view showing yet another configuration of a waste ink disposal apparatus using a pump in the transporting means.

FIG. 3*d* shows that the ink disposal cartridge 72 does not need to be positioned underneath the ink supply cartridge or reservoir 100 if a pumping device 96 is used.

Figure 4:
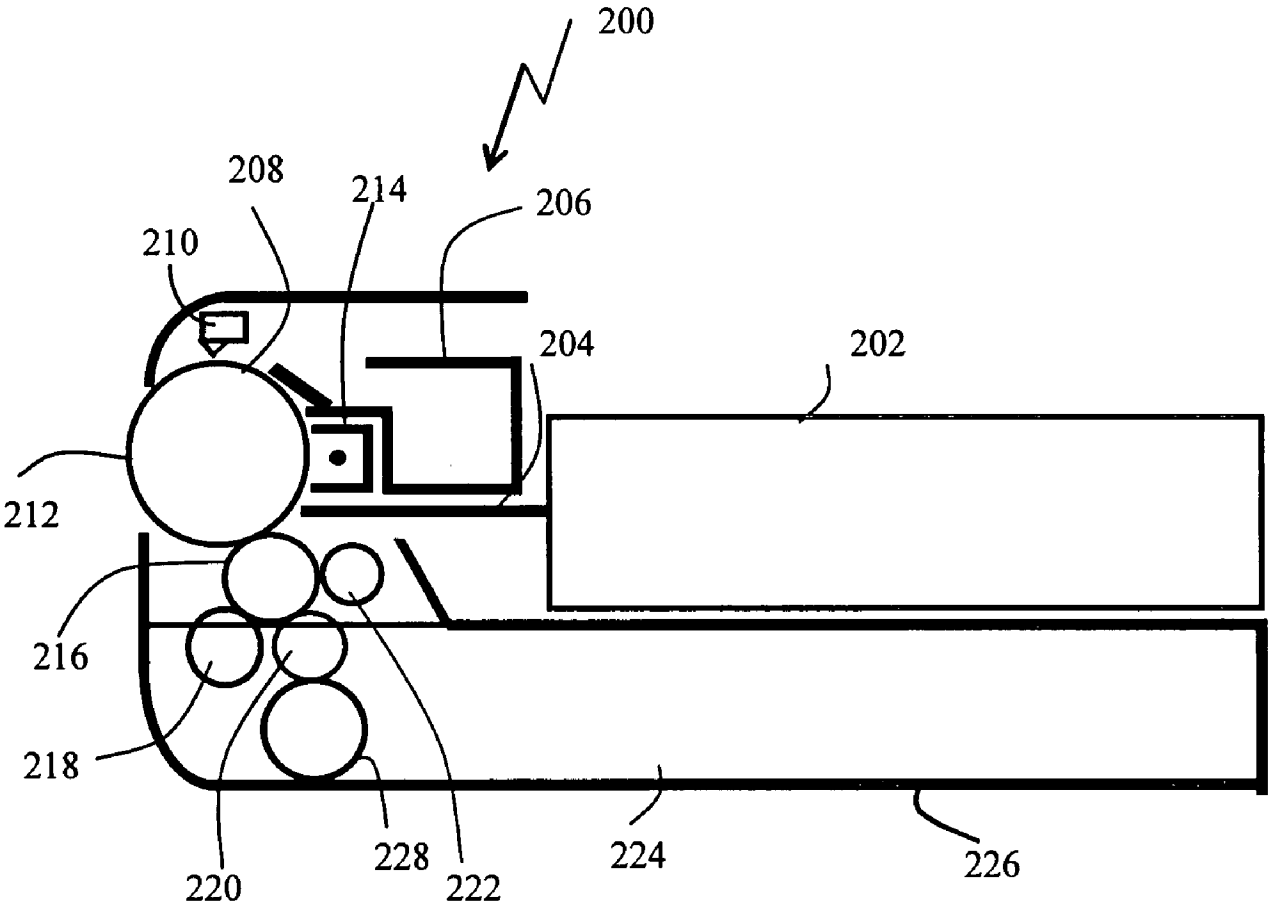
FIG. 4 shows an example of a type of supply cartridge that may be modified to handle waste ink.

FIG. 4 shows one embodiment of an ink supply cartridge 200. The ink cartridge 200 is contained in a housing 226 that is impervious to liquid toner. Within said housing, is mounted a photoreceptive member 212, a charging member 214 (shown here as a corona charging unit, but which may be a roll charger or the like), and a discharging member 202 (for example a laser discharging beam represented by 204). A quantity of liquid toner 224 is disposed within the housing. In this cartridge, the liquid toner is supplied to the development members via an ink supply roll 228. A depositing roll 220 attracts charged toner particles to the developer roll 216. The ink layer on the developer roll is controlled by the metering roll 222. After the discharged area on the photoreceptor 212 removes the toner layer from the developer roll 216, the developer cleaning roll 218 removes the unused toner back into the ink cartridge. After the toned area on the photoreceptor is transferred to the final media or to an intermediate transfer member (neither is shown), an erasing mechanism 210 discharges the entire length of the photoconductor, allowing the cleaning blade 208 to scrape excess toner particles and liquid from the photoconductor surface into a waste receptacle 206. One embodiment allows this remaining sludge to be collected and augured into a sealable flexible bag in the ink containing area of the housing (not shown).

Figure 5:
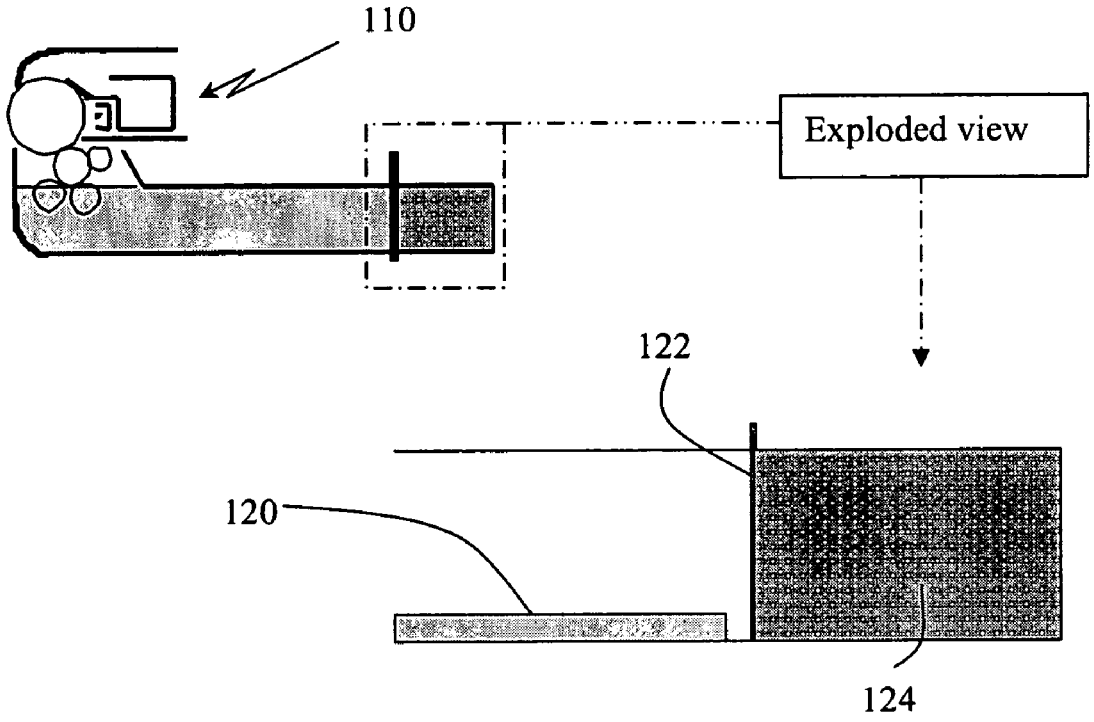
FIG. 5 shows a cutaway side view of a fully replaceable developer pod with a compartment for an absorbent and a mechanism for releasing that absorbent into the pod.

In FIG. 5, a cartridge of the type described in figure four (and its analogs), is shown modified for absorption. Even though a cartridge 110 such as the one described has enough parts that it may not be landfillable, there still exists a problem of transporting hazardous liquid waste and solidification is still a preferred solution. In the improved cartridge, a portion of the ink retention area is set apart from the remainder of the toner supply chamber (in this embodiment, the reserved area is at one end of the cartridge; it may be anywhere). This area 216 is sealed and separated from the liquid toner by a gate or door 122 that may be opened either manually or by the printing apparatus. The set-apart area contains a sufficient quantity of absorbent 124 to immobilize all of the ink in a full cartridge (in the event that for some reason it is desired to dispose of a full cartridge of toner). It is most likely, however, that the absorbent will be used to solidify remaining carrier liquid 120 after the solids have been printed out.

These and other features of the invention are claimed in a manner that allows alteration and the use of known or newly developed functional equivalents to the materials and structures used.

Figure 6:
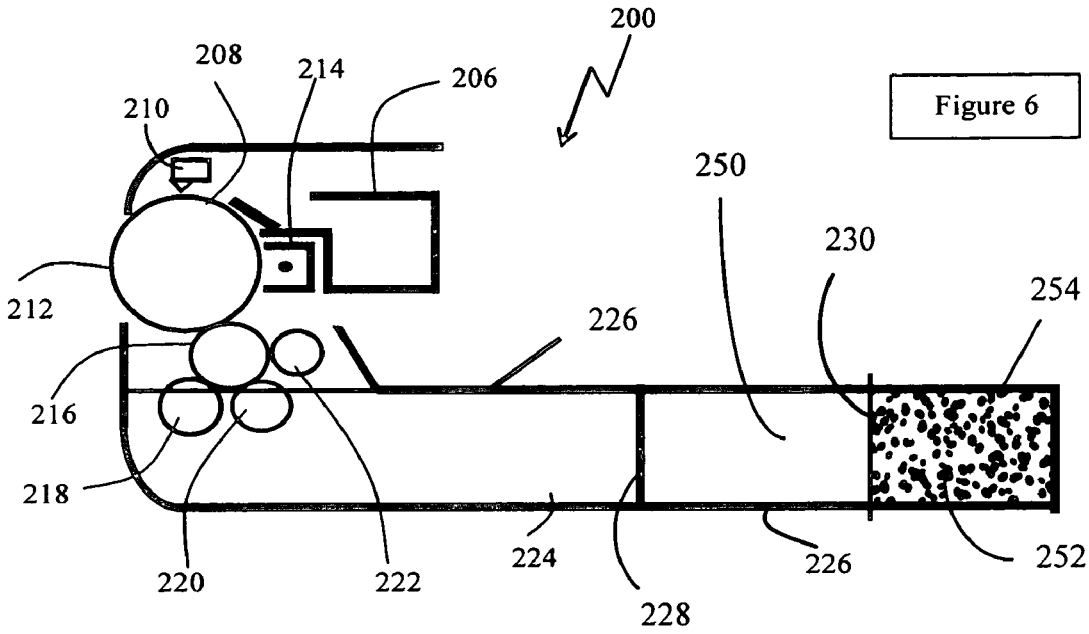
FIG. 6 shows a cartridge structure using absorbents according to the present invention.
Figure 7:
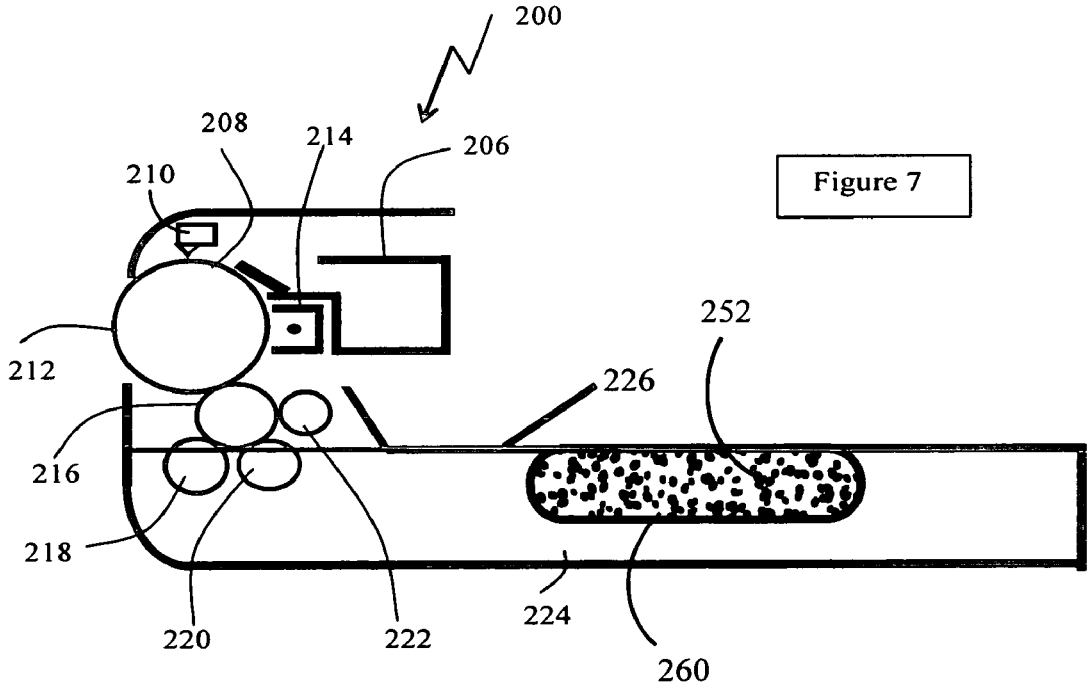
FIG. 7 shows a cartridge structure using absorbents according to the present invention.
Figure 8:
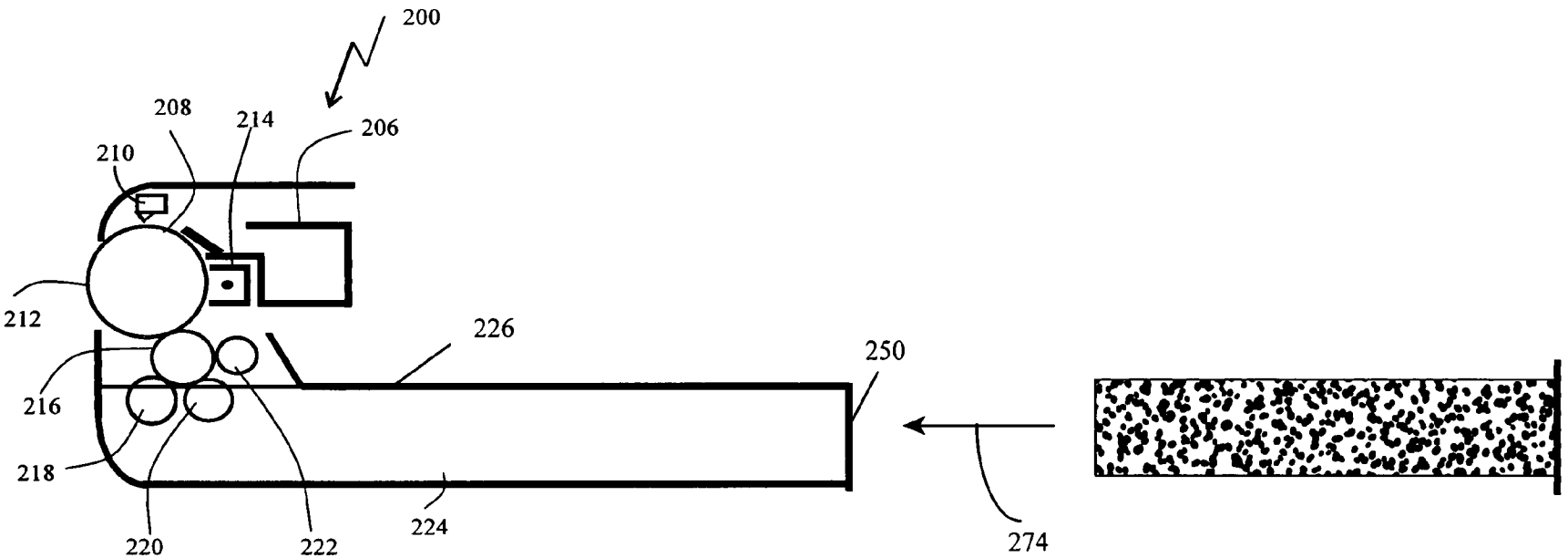
FIG. 8 shows a cartridge structure using absorbents according to the present invention.

In FIGS. 6, 7, and 8, are shown three different ways to use an absorbent with the developer cartridge system described in FIG. 4. In FIG. 7, the developer cartridge 200, comprising a housing 226, hardware elements 210, 212, 216, 218, 220, 222, 206, 208, and 214 (as described above in FIG. 4), and liquid toner 224, is modified by inserting a barrier or dividing wall 228 in the housing, creating a compartment 250 for waste toner. Although it is possible to include an oleophilic absorbent in the second compartment 250, so that the waste toner may be absorbed, FIG. 6 creates another compartment 254 by adding a moveable partition or door 230. Contained within the third compartment 254 is a quantity of oleophilic absorbent 252. Although FIG. 6 shows the compartments in a parallel sequence, it is possible that other arrangements could be made (e.g. the third compartment 254 is a sub-chamber located within second compartment 250). FIG. 6 also only shows one of a type of developer cartridges that may be designed specifically for an individual printer; it is understood that the figure described and referenced as FIG. 4 is merely illustrative.

In FIG. 7, the developer type described in FIG. 4 is modified by adding a waste ink compartment 260 that contains a quantity of oleophilic absorbent 252. The waste ink compartment 260 might be made of a rigid, solvent impermeable material, or it might be a flexible bag, for example, capable of expanding as the waste ink added to it increases and as the quantity of toner 224 in the developer 200 decreases.

FIG. 8 depicts a developer cartridge 200 as in FIG. 4, with the modification of one area of the developer housing to be an openable or moveable panel or door 250 (in this case, shown on an end). A second, absorbent component 280 is designed with a housing 270 which purpose is to hold a shape complementary to the inside of the developer cartridge 200. The housing 270 may be comprised of any material that is pervious to liquid toner and that will enable the shape of the absorbent component 280 to fit through the opening 250 and be inserted into the developer cartridge 200 (in FIG. 9, indicated by the arrow 274). The housing 270 will hold a quantity of oleophilic absorbent 252 for the purpose of absorbing waste and unused liquid toner and solvent. One surface of the absorbent component housing 270 might be modified to create a flange, stopper, or handle 272 for ease of insertion or (optionally) removal.

What is claimed is:

1. A disposal system comprising an electrophotographic printer and a cartridge for insertion in electrophotographic printers, the cartridge comprising:

a first liquid toner container, the first liquid toner container having an ink outlet, an ink disposal container having an ink inlet in fluid connection with the first liquid toner container, the ink disposal container having a predetermined level of ink capacity within the disposal container and a quantity of absorbent within the ink disposal container; and a sensor for sensing attainment of the predetermined level of ink capacity in the ink disposal container, wherein the quantity of absorbent within the ink disposal container comprises non-leachable absorbent that retains ink solvent with sufficient strength that ambient moisture and water in landfills would not remove 2% of the ink solvent in a six-month period at 20° C. when the absorbent contains 20% by weight ink solvent sitting in black dirt with 10% by weight water content.

2. The system according to claim 1 further comprising a transportation system that detachably connects the ink outlet on the first liquid toner container and the ink inlet on the ink disposal container.

3. The system of claim 2 wherein the transportation system is a hose or tube in fluid connection with the outlet on the first liquid toner container and the inlet of the ink disposal container.

4. The system of claim 1 further comprising a differential pressure means in fluid connection with the outlet on the first liquid toner container and the inlet of the ink disposal container.

5. The system of claim 1 further comprising a holding container or reservoir between the first liquid toner container and the ink disposal container for holding the waste or excess ink before it enters the ink disposal container.

6. The system of claim 1 further comprising a second cartridge or pellet comprising an absorbent that may be inserted or added into the ink disposal container.

7. The system of claim 1 wherein the sensor senses the weight or volume of the ink in the ink disposal container.

8. A disposal system comprising an electrophotographic printer and a cartridge for insertion in electrophotographic printers, the cartridge comprising:

a first liquid toner container, the first liquid toner container having an ink outlet, an ink disposal container having an ink inlet in fluid connection with the first liquid toner container, the ink disposal container having a predetermined level of ink capacity within the ink disposal container and a quantity of absorbent within the ink disposal container, and a sensor for sensing attainment of the predetermined level of ink capacity in the ink disposal container;

the system containing an inlet from the first liquid container to the disposal container, the inlet having a mechanical structure that opens and closes to enable movement of waste ink into the disposal container; and further comprising a transportation system that detachably connects the ink outlet on the first liquid toner container and the ink inlet on the ink disposal container and wherein the quantity of absorbent within the ink disposal container comprises a non-leachable absorbent that retains ink solvent with sufficient strength that ambient moisture and water in landfills would not remove 2% of the ink solvent in a six-month period at 20° C. when the absorbent contains 20% by weight ink solvent sitting in black dirt with 10% by weight water content.

9. The system of claim 8 wherein the transportations system is a hose or tube in fluid connection with the outlet on the first liquid toner container and the inlet of the ink disposal container.

10. The system of claim 8 further comprising a quantity of absorbent within the ink disposal container.

11. The system of claim 8 further comprising a holding container or reservoir between the first liquid toner container and the ink disposal container for holding the waste or excess ink before it enters the ink disposal container.

12. The system of claim 8 further comprising a second cartridge or pellet comprising an absorbent that may be inserted or added into the ink disposal container.

13. The system of claim 8 wherein the sensor senses the weight or volume of the ink in the ink disposal container.

14. A disposal system comprising an electrophotographic printer and a cartridge for insertion in electrophotographic printers, the cartridge comprising:

a first liquid toner container, the first liquid toner container having an ink outlet, an ink disposal container having an ink inlet in fluid connection with the first liquid toner container, the ink disposal container having a predetermined level of ink capacity within the ink disposal container and a quantity of absorbent within the ink disposal container, and a sensor for sensing attainment of the predetermined level of ink capacity in the ink disposal container:

the system containing an inlet from the first liquid container to the disposal container, the inlet having a mechanical structure that opens and closes to enable movement of waste ink into the disposal container further comprising a differential pressure means in fluid connection with the outlet on the first liquid toner container and the inlet of the ink disposal container.

* * * * *